US011247313B2

(12) United States Patent
St. Laurent

(10) Patent No.: US 11,247,313 B2
(45) Date of Patent: Feb. 15, 2022

(54) QUICK ADJUST PIPE WRENCH

(71) Applicant: Michael St. Laurent, Metis-Sur-Mer (CA)

(72) Inventor: Michael St. Laurent, Metis-Sur-Mer (CA)

( * ) Notice: Subject to any disclaimer, the term of this patent is extended or adjusted under 35 U.S.C. 154(b) by 234 days.

(21) Appl. No.: 16/784,191

(22) Filed: Feb. 6, 2020

(65) Prior Publication Data

US 2020/0254590 A1 Aug. 13, 2020

Related U.S. Application Data

(60) Provisional application No. 62/802,701, filed on Feb. 7, 2019.

(51) Int. Cl.
*B25B 13/50* (2006.01)
*B25B 23/00* (2006.01)

(52) U.S. Cl.
CPC ..... *B25B 13/5058* (2013.01); *B25B 23/0007* (2013.01)

(58) Field of Classification Search
CPC ..... B25B 13/5058; B25B 13/14
See application file for complete search history.

(56) References Cited

U.S. PATENT DOCUMENTS 1,990,137 A * 2/1935 Schrubb ..... B25B 13/16 81/160
3,200,677 A * 8/1965 Miranda ..... B25B 13/16 81/160
4,309,924 A * 1/1982 McLain ..... B25B 13/14 81/159
7,040,199 B2 * 5/2006 Gregory ..... B25B 13/5058 81/159
2001/0035076 A1 * 11/2001 Gilbert, Jr. ..... B25B 13/5058 81/142
2019/0299372 A1 * 10/2019 Lownik ..... B25G 1/04

* cited by examiner

*Primary Examiner* — David B. Thomas
(74) *Attorney, Agent, or Firm* — Brennan, Manna & Diamond, LLC

(57) ABSTRACT

An adjustable locking assembly for a pipe wrench structured and arranged to provide a modified nut assembly and locking assembly.

16 Claims, 4 Drawing Sheets

QUICK ADJUST PIPE WRENCH

The present application is related to and claims priority from prior provisional application Ser. No. 62/802,701, filed Feb. 7, 2019, the entire application of which is incorporated herein by reference.

BACKGROUND OF THE INVENTION

1. Field of the Invention

The present invention relates generally to the field of wrench devices and more specifically relates to an adjustable locking assembly for a pipe wrench structured and arranged to provide a modified nut assembly and locking assembly.

2. Description of the Related Art

A wrench is a tool used to provide grip and mechanical advantage in applying torque to turn objects-usually rotary fasteners, such as nuts and bolts—or keep them from turning. Pipe wrenches are used my many people but primarily plumbers. With normal pipe wrenches you have to turn/rotate the nut in a circular motion over and over again to adjust the pipe wrench. It's a slow process that wastes time and can be frustrating.

Further in sliding jaw wrenches, a movable hook jaw commonly is formed on an elongate shank which is mounted for longitudinal movement, to adjust the jaw opening, on a wrench handle, which is formed with the stationary or heel jaw. A screw mechanism with a rotary actuator, such as a nut, is commonly provided between the shank and the handle to effect adjusting movements of the movable hook jaw. The screw mechanism may be difficult to operate should dirt get in the threads, or should an operator's fingers be stiff or slippery, or when using with gloves. Moreover, an operator cannot fix a jaw opening in such a configuration. Furthermore, jaw adjustment of a conventional jaw wrench is quite long and tedious when going from a small configuration (ex. when using on a small-diameter pipe) to a much greater configuration (ex. when using on a large-diameter pipe).

Various attempts have been made to solve problems found in wrench device art. Among these are found in: U.S. Pat. No. 7,040,199 to N. Scott Gregory; U.S. Pat. No. 3,200,677 to Miranda William; U.S. Pat. No. 2,691,317 to Ernest T Olson; U.S. Pat. No. 3,340,753 to Schrader Raymond George; and U.S. Pub. No. 2006/0196319 to Hung et al. This prior art is representative of locking adjustable wrenches.

None of the above inventions and patents, taken either singly or in combination, is seen to describe the invention as claimed. Thus, a need exists for a reliable Quick Adjust Pipe Wrench, an adjustable locking assembly for a pipe wrench structured and arranged to provide a modified nut assembly and locking assembly and to avoid the above-mentioned problems.

BRIEF SUMMARY OF THE INVENTION

In view of the foregoing disadvantages inherent in the known wrench device art, the present invention provides a novel Quick Adjust Pipe Wrench. The general purpose of the present invention, which will be described subsequently in greater detail, is to provide an adjustable locking assembly for a pipe wrench structured and arranged to provide a modified nut assembly and locking assembly. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures that accompany the written portion of this specification illustrate embodiments and method(s) of use for the present invention, Quick Adjust Pipe Wrench, constructed and operative according to the teachings of the present invention.

Figure 1:
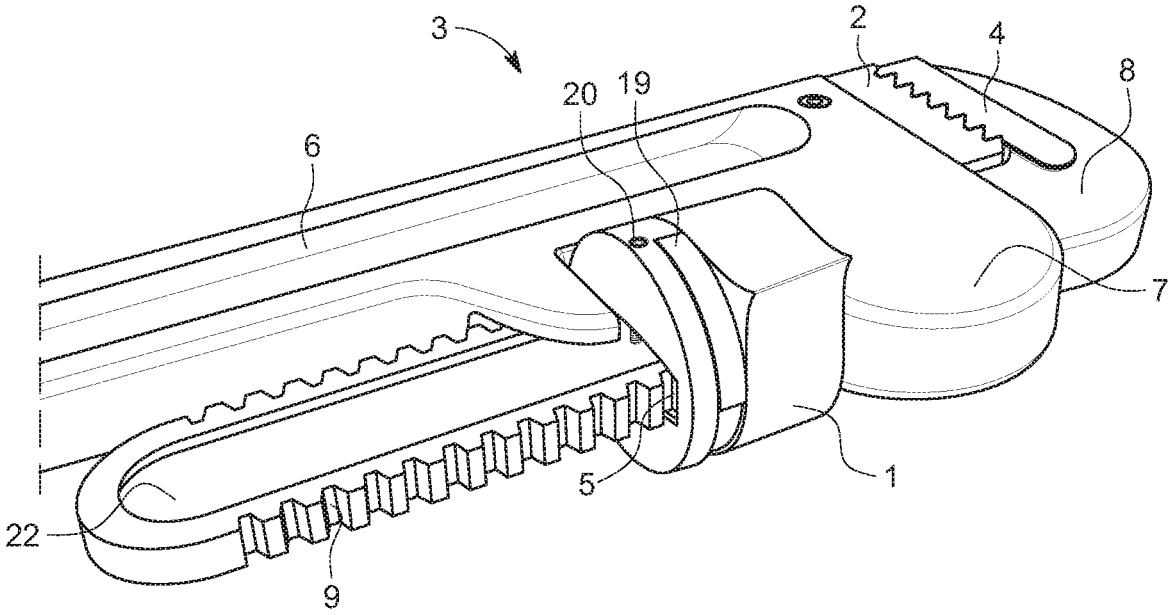
FIG. 1 shows a perspective view illustrating a quick adjust pipe wrench nut according to an embodiment of the present invention.

The various embodiments of the present invention will hereinafter be described in conjunction with the appended drawings.

DETAILED DESCRIPTION

As discussed above, embodiments of the present invention relate to a wrench device and more particularly to a quick adjust pipe wrench.

Referring now to the drawings FIGS. 1-7, the quick adjust pipe wrench is a novel product offering consumers a practical solution to the aforementioned challenges. As the name implies, the quick adjust pipe wrench is a specially designed improved adjustment and lock assembly for a pipe wrench. To use the presently claimed invention, a user rotates the wrench nut once to open the nut so the wrench jaw opening can be adjusted, and turns it again the other way to lock the nut, locking the jaw distance in place.

Figure 2:
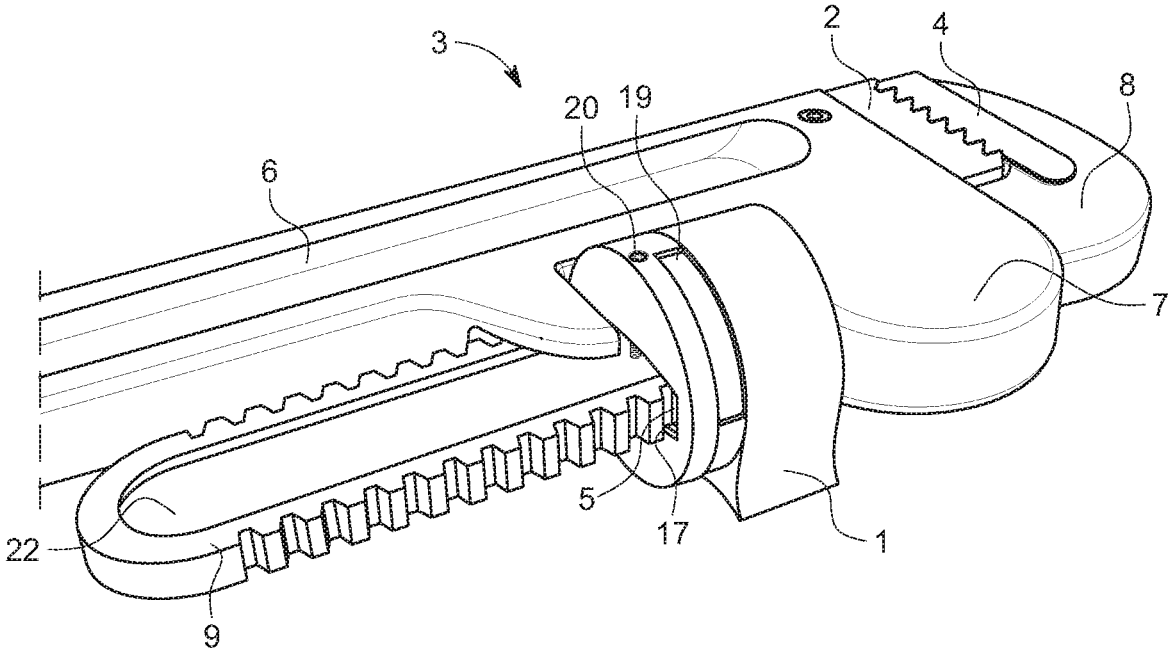
FIG. 2 shows a perspective view illustrating a quick adjust pipe wrench nut according to an embodiment of the present invention.
Figure 3:
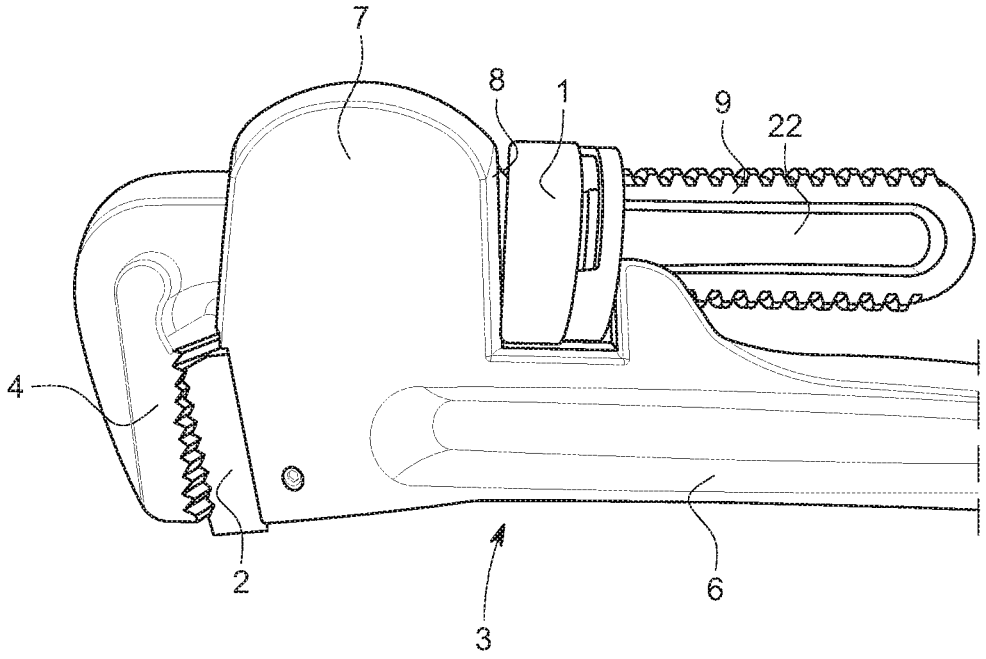
FIG. 3 shows a perspective view illustrating a quick adjust pipe wrench nut according to an embodiment of the present invention.
Figure 4:
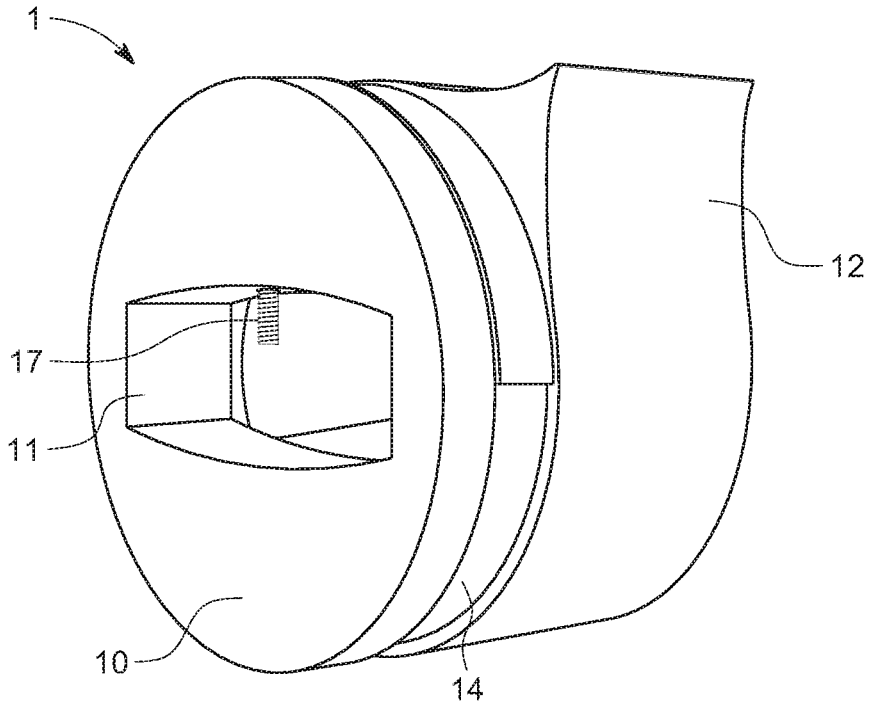
FIG. 4 shows a perspective view illustrating a quick adjust pipe wrench nut according to an embodiment of the present invention.
Figure 5:
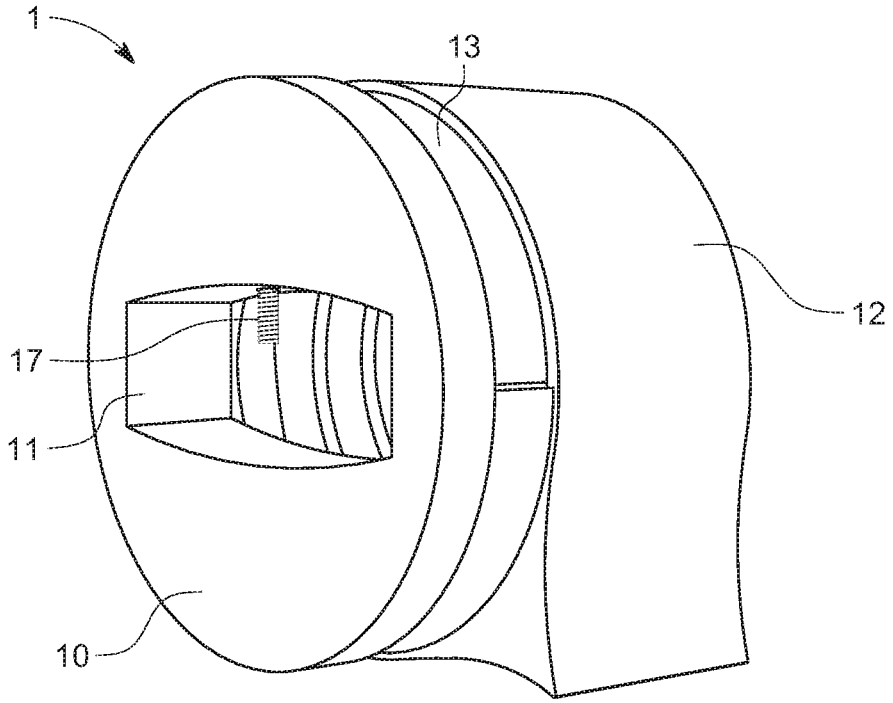
FIG. 5 shows a perspective view illustrating a quick adjust pipe wrench according to an embodiment of the present invention.

As shown in FIGS. 1-3, the pipe wrench 3 includes a handle 6 with a heel jaw 2 at one end and a hook jaw 4 housing 7 adjacent the heel jaw 2, the housing 7 having a housing opening 8 therethrough substantially parallel to the handle 6. A hook jaw element 4, 9 includes a threaded shank 9 extending through the opening 8 and a hook jaw 4 disposed over the heel jaw 2. The housing 7 opening 8 is sized to permit longitudinal displacement of the hook jaw element 4, 9 therethrough. An adjustment nut assembly 1 is used for adjusting and locking the position of the hook jaw element 4, 9 with respect to the heel jaw 2. The quick adjust pipe wrench nut 1 is manufactured to sit on a pipe wrench 3 adjacent to the hook jaw 4. The nut 1 has a housing opening 5 that is substantially parallel to the pipe wrench handle 6 when the nut 1 is located on the hook jaw 4.

As shown in FIGS. 4-7, the adjustment nut assembly 1 includes a first annular element 10 defining a first annular opening 11 sized to permit longitudinal displacement of the hook jaw element 4, 9 therethrough. A second annular element 12 is rotatable with respect to first annular element 10 between an open adjustment configuration 13 that permits free longitudinal displacement of the hook jaw element 4, 9 through the first and second annular elements 10, 12 and a locking configuration 14 that locks a longitudinal position of the hook jaw element 4, 9, once an appropriate separation between the hook jaw 4 and the heel jaw 2 is reached.

Additionally, as shown in FIGS. 1-2 and 4-5, in some embodiments, there is a longitudinal displacement limiting mechanism 17, such as a small metric stopper bolt, in the first annular opening 11 of the nut 1 to prevent displacement of the hook jaw element 4, 9 out of engagement with the adjustment nut assembly 1. The stopper bolt 17 is preferably 3 mm long, and blocks or stops the jaw shaft 9 from falling off the pipe wrench 3 when the nut 1 is in the unlocked mode 13 by preventing the hook jaw element 4, 9 from being excessively pulled out and thus falling off. A key 21 can be used to deploy and withdraw a longitudinal displacement limiting mechanism 17, such as a screw element. The hook jaw element 4, 9 typically includes a concave surface 22 along the molding cast iron shank 9. The screw element 21 is thus removably deployable and centered within the concave surface 22 of the shank 9.

Figure 6:
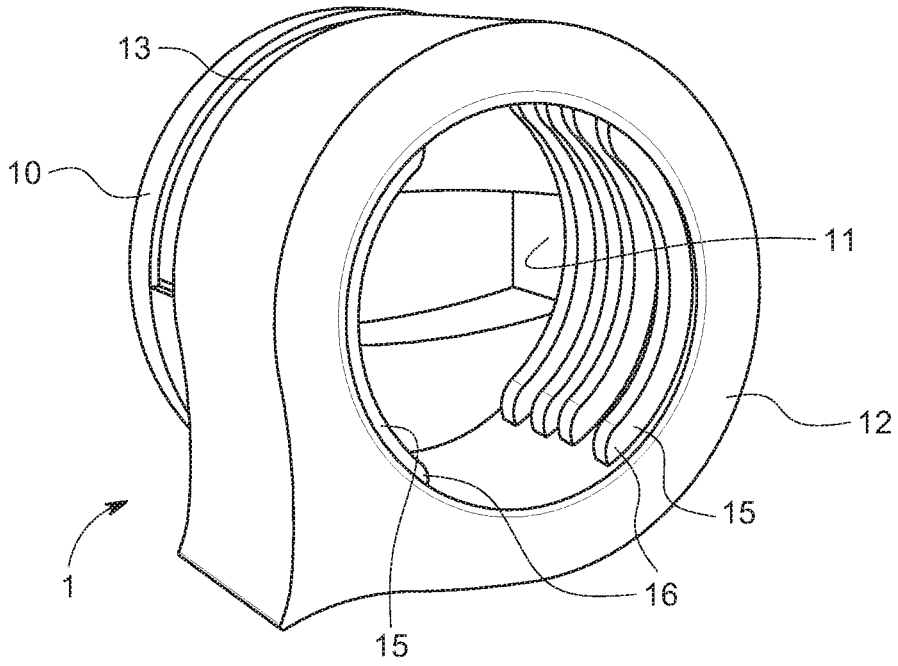
FIG. 6 shows a perspective view illustrating a quick adjust pipe wrench according to an embodiment of the present invention.
Figure 7:
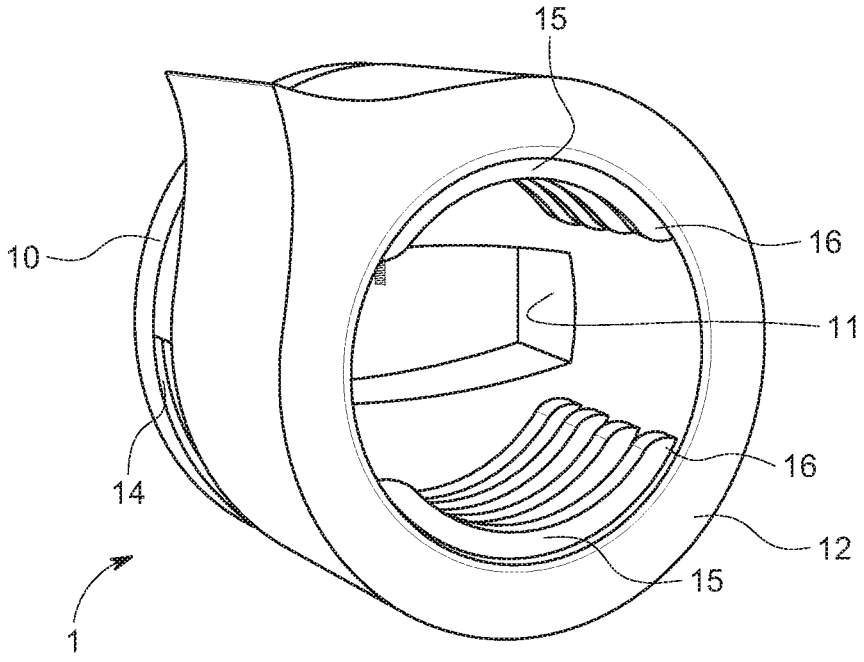
FIG. 7 shows a perspective view illustrating a quick adjust pipe wrench according to an embodiment of the present invention.

As shown in FIGS. 6-7, in some embodiments, the second annular element 12 includes a first pair of inner oppositely-facing threaded surfaces 15 shaped to cooperate with the threaded shank 9 on the hook jaw element 4, 9. Some embodiments also include a second pair of inner oppositely-facing surfaces 18 shaped to avoid contact with the threaded shank 9 when positioned above the shank 9 and to allow free longitudinal displacement of the shank 9 through the second annular element 12.

An important aspect of the threaded surfaces 15 or grooves is the narrowing of the threads 16 that allows the grooves to adjust and obtain a greater rotation process, which provides less resistance in the rotation motion with respect to the threaded shank 9. In other words, inside the nut 1, the edge 16 of the threads 15, where the threads 15 end, are pointed like an arrow head to allow the threads 15 to slide easily in the threads of the pipe wrench shaft 9 when rotated. Threads 15 other than those that rotate inside the pipe wrench shaft do not have to be pointed.

As shown in FIGS. 1-2, in some embodiments, a rotation limiting mechanism 19 is provided for limiting rotation of the second annular element 12 with respect to the first annular element 10. The rotation can be limited to 90 degrees clockwise or counterclockwise between the adjustment configuration 13 and the locking configuration 14. The limiting mechanism 19 prevents excessive degrees of rotation, which increase the easiness of the use of the device when adjusting the wrench for a given length. The rotation limiting mechanism 19 can include a locking component 20 (ex. screw, or any other suitable component).

In some embodiments, the adjustment nut assembly 1 is sized to be interchangeable with a standard internally treaded nut cooperating with the threaded shank 9 of the hook jaw element 4, 9 to adjust a longitudinal position of the hook jaw element 4, 9. Hence the assembly 1 can replace a previous method of adjusting the pipe wrench 3 with an alternative mechanism. The adjustment nut assembly 1 can be built and designed to have dimensions that accommodate the majority of manufactured pipe wrenches 3 on the market or can also be manufactured to adapt only to one specific kind of manufactured brand, for commercial advantage. The adjustment nut assembly 1 can have a same length as a standard internally treaded nut. The standard internally treaded nut can thus be easily removed from the wrench and replaced with the adjustment nut assembly. The quick adjust pipe wrench nut is cost-effective to produce in the embodiments, as shown in FIGS. 1-7.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claim:

1. A locking adjustable pipe wrench nut device comprising:

(a) a first annular element with a first annular opening therein, wherein the first annular opening is operably sized to permit longitudinal displacement of a hook jaw element of a pipe wrench; and (b) a second annular element, wherein the second annular element is rotatable with respect to the first annular element between an open adjustment configuration that permits free longitudinal displacement of the hook jaw element of the pipe wrench and a locking configuration that locks a longitudinal position of the hook jaw element at a desired separation between the hook jaw element and a heel jaw of the pipe wrench.

2. The locking adjustable pipe wrench nut device according to claim 1, further comprising:

(c) a longitudinal displacement limiting mechanism operably located in the first annular opening to prevent displacement of the hook jaw element out of the locking adjustable pipe wrench device.

3. The locking adjustable pipe wrench nut device according to claim 2, wherein the longitudinal displacement limiting mechanism is a stopper bolt.

4. The locking adjustable pipe wrench nut device according to claim 3, wherein the stopper bolt has a length of 3 mm.

5. The locking adjustable pipe wrench nut device according to claim 2, wherein the longitudinal displacement limiting mechanism is removably deployable by a key.

6. The locking adjustable pipe wrench nut device according to claim 5, wherein the key is a screw element.

7. The locking adjustable pipe wrench nut device according to claim 1, wherein the second annular element further comprises:

(i) a first pair of inner oppositely-facing threaded surfaces having arrow-shaped ends, wherein the first pair of inner oppositely-facing threaded surfaces are operably designed to cooperate with a threaded shank on the hook jaw element.

8. The locking adjustable pipe wrench nut device according to claim 7, wherein the second annular element further comprises:

(ii) a second pair of inner oppositely-facing surfaces, wherein the second pair of inner oppositely facing surfaces are operably designed to avoid contact with the threaded shank of the hook jaw element when positioned about the threaded shank, thereby allowing free longitudinal displacement of the threaded shank through the second annular element.

9. The locking adjustable pipe wrench nut device according to claim 1, further comprising:

(c) a rotation limiting mechanism operably connected to limit rotation of the second annular element with respect to the first annular element between the open adjustment configuration and the locking configuration.

10. The locking adjustable pipe wrench nut device according to claim 9, wherein the rotation limiting mechanism limits rotation of the second annular element to 90 degrees clockwise or 90 degrees counterclockwise with respect to the first annular element between the open adjustment configuration and the locking configuration.

11. A locking adjustable pipe wrench nut device comprising:

(a) a first annular element with a first annular opening therein, wherein the first annular opening is operably sized to permit longitudinal displacement of a hook jaw element of a pipe wrench;

(b) a second annular element with (i) a first pair of inner oppositely-facing threaded surfaces having arrow-shaped ends, wherein the first pair of inner oppositely-facing threaded surfaces are operably designed to cooperate with a threaded shank on the hook jaw element; and (ii) a second pair of inner oppositely-facing surfaces, wherein the second pair of inner oppositely facing surfaces are operably designed to avoid contact with the threaded shank of the hook jaw element when positioned about the threaded shank, thereby allowing free longitudinal displacement of the threaded shank through the second annular element, wherein the second annular element is rotatable with respect to the first annular element between an open adjustment configuration that permits free longitudinal displacement of the hook jaw element of the pipe wrench and a locking configuration that locks a longitudinal position of the hook jaw element at a desired separation between the hook jaw element and a heel jaw of the pipe wrench;

(c) a longitudinal displacement limiting mechanism operably located in the first annular opening to prevent displacement of the hook jaw element out of the locking adjustable pipe wrench device, wherein the longitudinal displacement limiting mechanism is removably deployable by a key; and (d) a rotation limiting mechanism operably connected to limit rotation of the second annular element with respect to the first annular element between the open adjustment configuration and the locking configuration.

12. A combination of a pipe wrench with a locking adjustable wrench nut device, the combination comprising:

(a) a pipe wrench having (i) a heel jaw;

(ii) a hook jaw element with a hook jaw and a threaded shank, wherein the hook jaw is moveable with respect to the heel jaw; and (iii) a handle; and (b) a locking adjustable pipe wrench nut device having (i) a first annular element with a first annular opening therein, wherein the first annular opening is operably sized to permit longitudinal displacement of the hook jaw element of the pipe wrench;

(ii) a second annular element with (1) a first pair of inner oppositely-facing threaded surfaces having arrow-shaped ends, wherein the first pair of inner oppositely-facing threaded surfaces are operably designed to cooperate with a threaded shank on the hook jaw element; and (2) a second pair of inner oppositely-facing surfaces, wherein the second pair of inner oppositely facing surfaces are operably designed to avoid contact with the threaded shank of the hook jaw element when positioned about the threaded shank, thereby allowing free longitudinal displacement of the threaded shank through the second annular element, wherein the second annular element is rotatable with respect to the first annular element between an open adjustment configuration that permits free longitudinal displacement of the hook jaw element of the pipe wrench and a locking configuration that locks a longitudinal position of the hook jaw element at a desired separation between the hook jaw element and a heel jaw of the pipe wrench;

(iii) a longitudinal displacement limiting mechanism operably located in the first annular opening to prevent displacement of the hook jaw element out of the locking adjustable pipe wrench device, wherein the longitudinal displacement limiting mechanism is removably deployable by a key; and (iv) a rotation limiting mechanism operably connected to limit rotation of the second annular element with respect to the first annular element between the open adjustment configuration and the locking configuration.

13. The combination of a pipe wrench with a locking adjustable wrench nut device according to claim 12, wherein the longitudinal displacement limiting mechanism is a stopper bolt.

14. The combination of a pipe wrench with a locking adjustable wrench nut device according to claim 13, wherein the stopper bolt has a length of 3 mm.

15. The combination of a pipe wrench with a locking adjustable wrench nut device according to claim 12, wherein the key is a screw element.

16. The combination of a pipe wrench with a locking adjustable wrench nut device according to claim 12, wherein the rotation limiting mechanism limits rotation of the second annular element to 90 degrees clockwise or 90 degrees counterclockwise with respect to the first annular element between the open adjustment configuration and the locking configuration.

* * * * *